US011382431B2

(12) United States Patent
Gravlo

(10) Patent No.: US 11,382,431 B2
(45) Date of Patent: Jul. 12, 2022

(54) RETRACTABLE SEAT FOR A PERCHED POSITION

(71) Applicant: Bertrand Gravlo, Nice (FR)

(72) Inventor: Bertrand Gravlo, Nice (FR)

( * ) Notice: Subject to any disclaimer, the term of this patent is extended or adjusted under 35 U.S.C. 154(b) by 0 days.

(21) Appl. No.: 17/048,559

(22) PCT Filed: Apr. 12, 2019

(86) PCT No.: PCT/EP2019/059393

§ 371 (c)(1),
(2) Date: Oct. 16, 2020

(87) PCT Pub. No.: WO2019/201760

PCT Pub. Date: Oct. 24, 2019

(65) Prior Publication Data

US 2021/0161298 A1 Jun. 3, 2021

(30) Foreign Application Priority Data

Apr. 19, 2018 (FR) ..... 1853475

(51) Int. Cl.
*A47C 3/20* (2006.01)
*A47C 3/34* (2006.01)
(Continued)

(52) U.S. Cl.
CPC ..... *A47C 9/025* (2013.01); *A47C 9/027* (2013.01); *A47C 7/029* (2018.08)

(58) Field of Classification Search
CPC ..... A47C 9/025; A47C 9/027; A47C 7/029
(Continued)

(56) References Cited

U.S. PATENT DOCUMENTS 4,148,523 A 4/1979 Brand et al.
4,793,654 A * 12/1988 Takafuji ..... A47C 3/20 297/338 X (Continued)

FOREIGN PATENT DOCUMENTS

CN 201022746 Y 2/2008
CN 201042308 Y 4/2008

(Continued)

OTHER PUBLICATIONS

International Search Report from corresponding International Application No. PCT/EP2019/059393, dated Jun. 14, 2019, pp. 1-4, European Patent Office, Rijswijk, The Netherlands.

(Continued)

*Primary Examiner* — Rodney B White
(74) *Attorney, Agent, or Firm* — Hauptman Ham, LLP

(57) ABSTRACT

A collapsible seat having a base and configured to alternatively take a use position and a storage position wherein the seat is collapsed. The seat includes first and second modules. The first module rotates in a vertical plane having longitudinal elements forming a deformable quadrilateral. The first module is articulated about an axis of rotation mounted on a fixed support and, in the use position, at least two longitudinal elements are in surface contact blocking rotation of the first module along a direction of rotation. The second module, mobile in rotation in the same vertical plane as the first module, has a support leg for surface contact with the ground in the use position and a connecting rod fixed between the first module and the support leg. In the use position, the connecting rod and the support leg are in surface contact blocking rotation of the second module.

15 Claims, 3 Drawing Sheets

(51) Int. Cl.

| | |
|---|---|
| ***A47C 4/00*** | (2006.01) |
| ***A47C 4/12*** | (2006.01) |
| ***A47C 9/02*** | (2006.01) |
| *A47C 7/02* | (2006.01) |

(58) Field of Classification Search
USPC ..... 297/337, 338, 20, 21, 24, 25, 29, 354.12
See application file for complete search history.

(56) References Cited

U.S. PATENT DOCUMENTS

| | | | | | |
|---|---|---|---|---|---|
| 4,884,842 | A * | 12/1989 | Finkelstein | A47C 9/06 | 297/337 X |
| 5,511,855 | A | 4/1996 | Miles | | |
| 5,609,390 | A * | 3/1997 | Takafuji | A47C 9/025 | 297/338 X |
| 5,720,522 | A * | 2/1998 | Habeck | A47C 9/06 | 297/337 X |
| 5,868,469 | A * | 2/1999 | Ming | A47C 9/025 | 297/338 |
| 5,887,947 | A * | 3/1999 | Chi | A47C 1/022 | 297/337 |
| 5,967,544 | A * | 10/1999 | Kanta | A47C 9/027 | 280/47.24 |
| 6,318,801 | B1 * | 11/2001 | Tkafuji | A47C 3/28 | 297/338 |
| 8,216,114 | B1 * | 7/2012 | Wynn, III | A63B 23/0458 | 297/338 X |
| 8,220,872 | B2 * | 7/2012 | Hong | A47C 3/30 | 297/337 X |
| 10,716,405 | B2 * | 7/2020 | Pearson | A47G 27/0231 | |

FOREIGN PATENT DOCUMENTS

| | | | |
|---|---|---|---|
| CN | 201178851 | Y | 1/2009 |
| CN | 201182335 | Y | 1/2009 |
| CN | 202009871 | U | 10/2011 |
| CN | 202075311 | U | 12/2011 |
| CN | 202391776 | U | 8/2012 |
| CN | 202555616 | U | 11/2012 |
| CN | 203088282 | U | 7/2013 |
| CN | 203092522 | U | 7/2013 |
| CN | 203315257 | U | 12/2013 |
| CN | 203468076 | U | 3/2014 |
| CN | 204670712 | U | 9/2015 |
| CN | 105064334 | A | 11/2015 |
| EP | 2724642 | A1 | 4/2014 |
| FR | 2935879 | A1 | 3/2010 |
| FR | 2979526 | A1 | 3/2013 |
| FR | 3017787 | A1 | 8/2015 |
| FR | 3019019 | A1 | 10/2015 |
| FR | 3022443 | A1 | 12/2015 |
| FR | 3023146 | A1 | 1/2016 |
| JP | 2000197537 | A | 7/2000 |
| JP | 2013119739 | A | 6/2013 |
| JP | 20140070671 | A | 4/2014 |
| KR | 101486188 | B1 | 1/2015 |
| WO | 2010072344 | A1 | 7/2010 |
| WO | 2012080135 | A1 | 6/2012 |
| WO | 2013065986 | A1 | 5/2013 |

OTHER PUBLICATIONS

Written Opinion from corresponding International Application No. PCT/EP2019/059393, pp. 1-6, European Patent Office, Rijswijk, The Netherlands.

* cited by examiner

RETRACTABLE SEAT FOR A PERCHED POSITION

The present application is a National Phase of International Application Number PCT/EP2019/059393, filed Apr. 12, 2019, which claims priority to French Application No. 1853475, filed Apr. 19, 2018.

TECHNICAL FIELD OF THE INVENTION

The invention relates to a collapsible seat, for a fold-up position.

It belongs to the field of seats and will have the application thereof, in particular, in supporting a user in a fold-up position during work requiring a station of this type.

STATE OF THE ART

In numerous situations, work must be carried out in an upright position or an intermediate position, called fold-up position. This is in particular the case in factories on assembly lines, when selling in a shop or behind counters. The operator cannot be in the seated position, due to the configuration of the workstation and possible movements to make. In particular, in pharmacies, operators work standing up behind their workstation and must regularly move around to go and get medication and other requested products. However, long periods at the station standing up lead to complications at the level of the legs such as pains or heavy leg syndromes.

There are devices which are intended to keep the operator in the seated position, more or less standing up, such as stools. In particular, patent FR 2935879 describes a low-bulk adjustable and foldable fold-up seat. However, this seat does not make it possible for the user to exert a relatively high horizontal pressure, at the risk of being destabilised by lack of support on the ground. In addition, it has a notable base at the level of the legs, which impedes the movements of the operator behind their workstation. Finally, the implementation and the storage of this seat are difficult steps which could not be carried out at any time by the user.

There is therefore a need to propose a solution which responds at least partially to the limitations outlined above.

SUMMARY OF THE INVENTION

To achieve this aim, according to an embodiment, the present invention provides a collapsible seat, comprising a base intended to receive the buttocks of a user, in particular a buttock support, the base being configured to alternatively take a position of use, wherein the seat is deployed such that the base can support the buttocks of the user and a storage position, wherein the seat is collapsed, the base not being able to receive the buttocks of the user, in particular a buttock support, characterised in that the seat comprises:

- a first module, mobile in rotation in a vertical plane comprising longitudinal elements configured to form a deformable quadrilateral, the first module being articulated about at least one first axis of rotation mounted on a fixed support, configured such that in the position of use, at least two longitudinal elements are in surface contact, blocking the rotation of the first module along at least one direction of rotation.

Advantageously, the seat also comprises a second module, mobile in rotation in the same vertical plane as the first module comprising a support leg configured to be in surface contact with the ground in position of use and a connecting rod fixed at a first end to the first module and at a second end to the support leg, the second module being configured such that in the position of use, the connecting rod and the support leg are in surface contact, blocking the rotation of the second module along at least one direction of rotation.

The present invention has the advantage of proposing a seat which makes it possible for the user to rest in the fold-up position easily behind their workstation by deploying the seat with advantageously one single rotation movement, while limiting and making it possible for a support comprising a horizontal component which could be the main component. Indeed, due to the connection of the seat to a fixed point, whether a furniture unit or a base, the support of the user does not have to be mainly vertical at the risk of making the seat move back or tilt. In addition, the seat does not require any difficult mounting or dismounting. Conversely, by a simple tilting, the first module and the second module pass from the position of use to the storage position, thus making it possible for the user to pass from the fold-up position to the upright position, to move or clear the station, by simplifying the storage of the seat.

Advantageously, the seat comprises a spring element making it possible for a return to the storage position of the seat from the removal of a support on the base or by facilitating the manoeuvre thereof by reducing the force.

Advantageously, the seat comprises a device for adjusting the height of the base, such that the seat can be adapted for different users.

Another aspect of the present invention relates to a method for using a fold-up seat comprising the following steps:

- Deployment of the seat from a storage position to a position of use comprising the tilting of the first module in a vertical plane along a direction of rotation about at least one axis of rotation simultaneously to the tilting of the support leg in the same vertical plane about an axis of rotation until the support leg is in surface contact with the ground and that at least two longitudinal elements of the first module are in contact with one another so as to block the rotation of the first module along at least one direction of rotation and that the support leg and the connecting rod thereof are in contact with one another so as to block the rotation of the second module along at least one direction of rotation.

Collapsing of the seat from the position of use to the storage position comprising the tilting of the support leg in the vertical plane about an axis of rotation in the direction of rotation contrary to that of the deployment step simultaneously to the first module in the same vertical plane along a direction of rotation contrary to that of the deployment step about at least one axis of rotation.

BRIEF DESCRIPTION OF THE FIGURES

The aims, objectives, as well as the features and advantages of the invention will emerge better from the detailed description of an embodiment of the latter which is illustrated by the supporting drawings according to which:

FIG. 1 represents the collapsed position of the seat. FIG. 2 represents the position of use of the seat.

Figure 1:
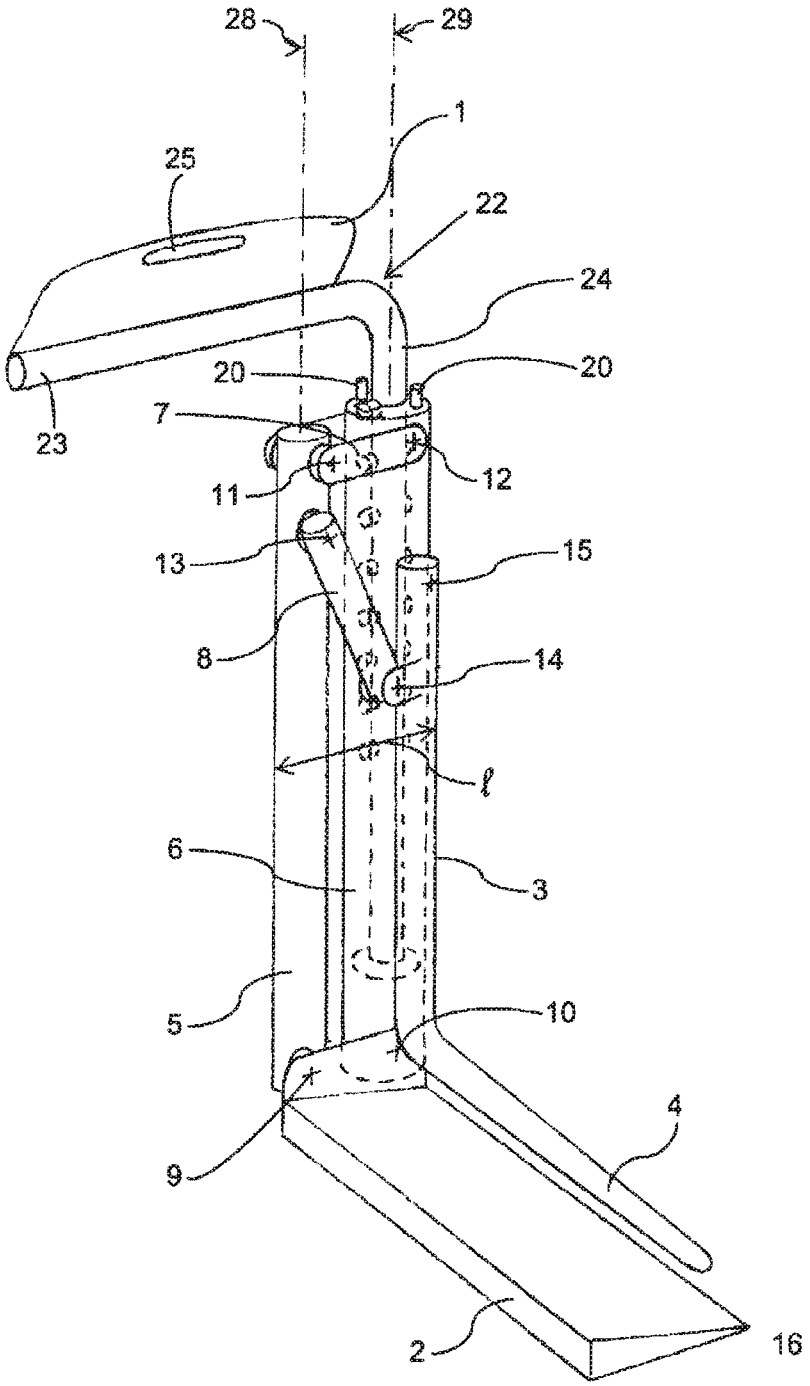
FIGS. 1 to 2 are schematic representations of two positions of the seat according to the invention as a three-quarter view.

The drawings are given as examples and are not limiting of the invention. They constitute principle schematic representations intended to facilitate the understanding of the invention and are not necessarily to the scale of practical applications.

DETAILED DESCRIPTION OF THE INVENTION

Before starting a detailed review of embodiments of the invention, below are stated optional features which can optionally be used in association or alternatively:

- Advantageously, the first module comprises a first longitudinal element and a second longitudinal element respectively fixed at the lower ends thereof to the fixed support by a first axis of rotation and a second axis of rotation, the first and the second axis of rotation being parallel.
- Advantageously, the fixed support is integral with an external element, preferably a furniture unit.
- Advantageously, the fixed support is a base, in particular provided to receive the support of the feet of the user, in the scope of a use as a freestanding seat.
- Advantageously, the first longitudinal element and the second longitudinal element are connected to one another at the upper ends thereof by a rod. The assembly of the first module forms a deformable quadrilateral making it possible for a particularly easy deployment and collapsing of the seat, which could advantageously also act as an element for blocking the seat, in the position of use.
- Advantageously, the support leg comprises a foot extending transversally and making it possible for the support surface of the leg on the ground.
- Advantageously, the connecting rod is arranged in the upper portion of the support leg remotely.
- Advantageously, the connecting rod is fixed at an end to the first longitudinal element by an axis of rotation and at the opposite end thereof to the support leg by an axis of rotation.
- Advantageously, the support leg is fixed by an axis of rotation (a fourth axis of rotation) to the second longitudinal element of the first module.
- Advantageously, the base is mounted on a bracket comprising a cross member and a vertical mount, advantageously mounted sliding in the second longitudinal element of the first module.
- Advantageously, the vertical mount is configured to be mobile in rotation relative to the second longitudinal element of the first module.
- Advantageously, the seat comprises a device for adjusting the height of the base. Advantageously, the adjustment device comprises tabs spaced apart over the length of the bracket.
- Advantageously, the base comprises a gripping element making it possible for the gripping of the base by the use and the passage to the position of use of the seat.
- Advantageously, the seat comprises a spring element making it possible for an automatic return to the storage position of the seat from the absence of force on the base.
- Advantageously, the method of use comprises, in the deployment of the seat, the gripping of the base making it possible for the driving of the tilting of the first module and of the support leg.
- Advantageously, the method of use comprises the adjustment of height of the base by sliding and rotation of the base relative to the second longitudinal element of the first module.

The use of the indefinite article "a" or "an" for an element or a step does not exclude, unless otherwise specified, the presence of a plurality of such elements or steps.

The invention relates to a collapsible seat, between a position of use and a storage position. The seat is in particular intended for a user in the fold-up position. By fold-up position, this means an intermediate position between the upright position and the seated position, i.e. an upright position wherein a portion of the weight of the user is transmitted by the pressure of their buttocks on a base. The invention can however also be completely used for a seated position. The difference will be the height of the base relative to the ground: if it is high, the seat will be intended for a fold-up position if it is lower, the seat will be intended for a seated position.

The seat according to the invention comprises a base 1 advantageously mounted on a bracket 22 comprising a cross member 23 and a vertical mount 24. Such as illustrated in the figures, the base 1 is a substantially flat surface configured to receive at least partially the buttocks of the user.

Figure 2:
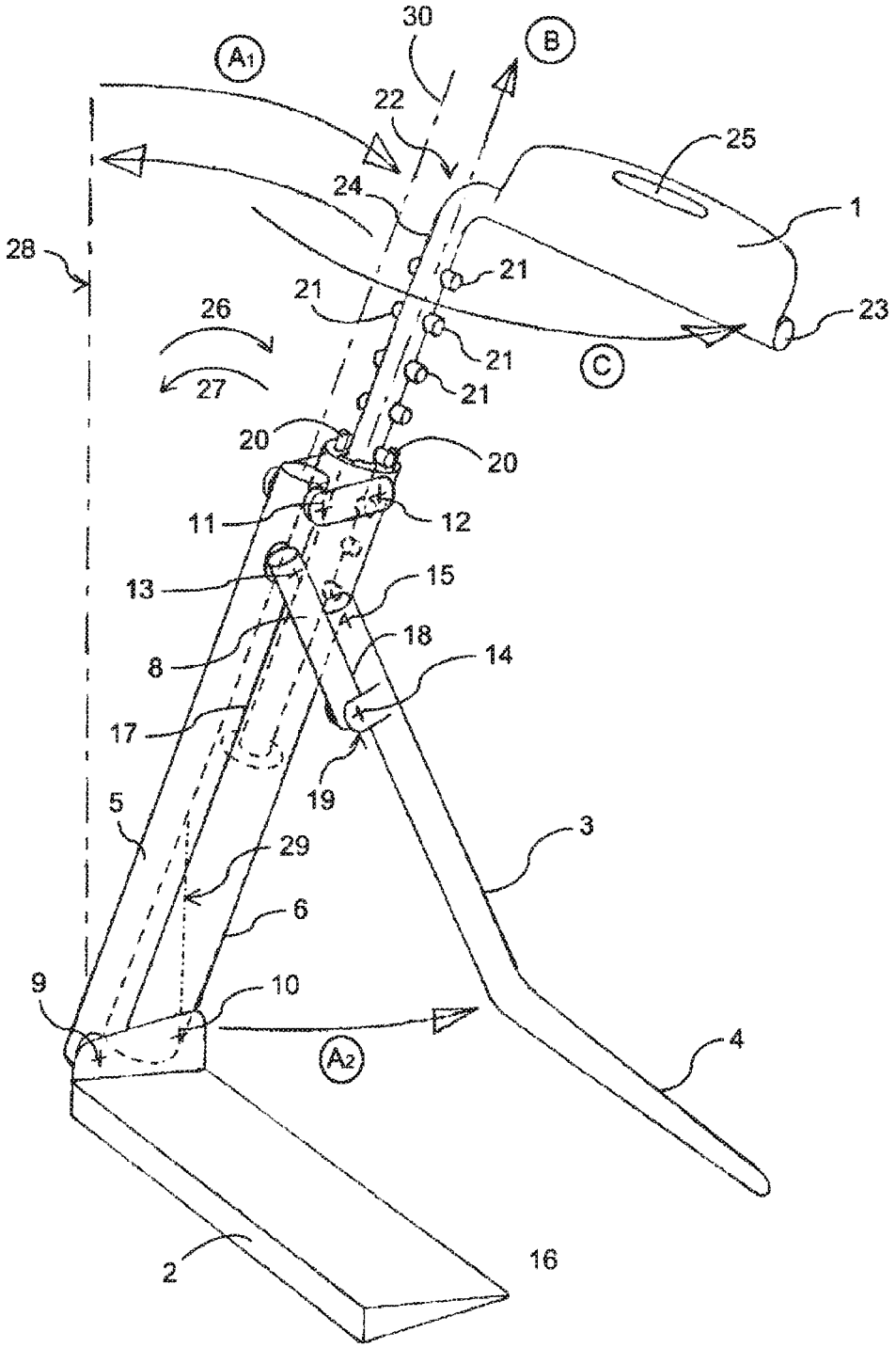

The seat is configured to alternatively take a position of use and a storage position respectively illustrated in FIGS. 2 and 1.

In the storage position, the seat is collapsed, i.e. that the base is arranged so as to not be able to receive the buttocks of a user.

Conversely, in the position of use, the seat is deployed, i.e. that the base 1 is arranged so as to be able to receive the buttocks of a user, more specifically the pressure of the buttocks of a user.

In this way, the collapsed seat has a minimum bulk, advantageously less than 20 cm. By bulk, this means the width of the seat in the collapsed position.

The seat characteristically comprises a first module, mobile in rotation in a vertical plane about a fixed point comprising at least one axis of rotation 9-10. Preferably, the at least one axis of rotation 9-10 is arranged on a fixed support 2.

The fixed support 2 can be either a base, or an external element such as a furniture unit. The fixed support 2 as indicated must be fixed and resist the tilting movement and the force transmitted by the pressure of the user on the base 1.

The seat according to the invention is particularly advantageous, as the implementation thereof behind a workstation is rapid, easy, without damaging the furniture. The seat is either independent, thanks to an independent base placed for example at the foot of the workstation of the user, or the seat is fixed directly to the furniture of the workstation, for example.

The first module comprises longitudinal elements 5-6, configured to form a deformable quadrilateral. Advantageously, the first module comprises a first longitudinal element 5 and a second longitudinal element 6. The first longitudinal element 5 and the second longitudinal element 6 are advantageously connected at the lower ends thereof to the fixed support 2 and in the upper portion by a rod 7. The quadrilateral is therefore formed by two longitudinal elements 5-6, the rod 7, and the fixed support 2. Each longitudinal element 5-6 is mobile in rotation about an axis of rotation 9-10 arranged on the fixed support 2. Advantageously, the two axes of rotation 9-10 are parallel and extend perpendicularly to the vertical plane wherein the first module is mobile. The rod 7 connects the first longitudinal element 5 and the second longitudinal element 6 by two articulations each comprising an axis of rotation 11-12. The two axes of rotation 11-12 are parallel and extend perpendicularly to the vertical plane, wherein the first module is mobile. Preferably, the distance between the two axes of rotation 11-12 is equal, even less than the distance between the two axes of rotation 9-10.

This arrangement makes it possible to have a stopping of the rotation of the first module, by contact between the first longitudinal element 5 and the second longitudinal element 6. The contact between the two longitudinal element 5-6 is made advantageously by surface contact 17 preventing the rotation of the first module in the deployment direction of the seat.

Advantageously, the seat comprises a second mobile module in rotation in the same vertical plane as the first module or in a parallel vertical plane about at least one axis of rotation 15. The vertical planes wherein the first module and the second module are mobile in rotation, are combined or parallel. The second module comprises a support leg 3 connected to the first module. According to a preferred possibility, the second module comprises a connecting rod 8. The connecting rod 8 connects the first module, more specifically the longitudinal element 5, to the support leg 3. The connecting rod 8 comprises two articulations making it possible for a mobility in rotation about two axes of rotation 13-14, respectively arranged at each of the ends thereof. According to an embodiment presented in FIG. 3, the axis of rotation 13 of the connecting rod 8 is combined with the axis of rotation 11 of the rod 7. The connecting rod 8 and the rod 7 have a common axis of rotation on the first longitudinal element 5. Preferably, the connecting rod 8 is arranged remote from the longitudinal axis of the support leg 3. The support leg 3 comprises tabs 19 receiving a transversal axis constituting the axis of rotation 14 of the lower end of the connecting rod 8. This arrangement makes it possible for the second module to comprise a blocking element in the position of use.

Figure 3:
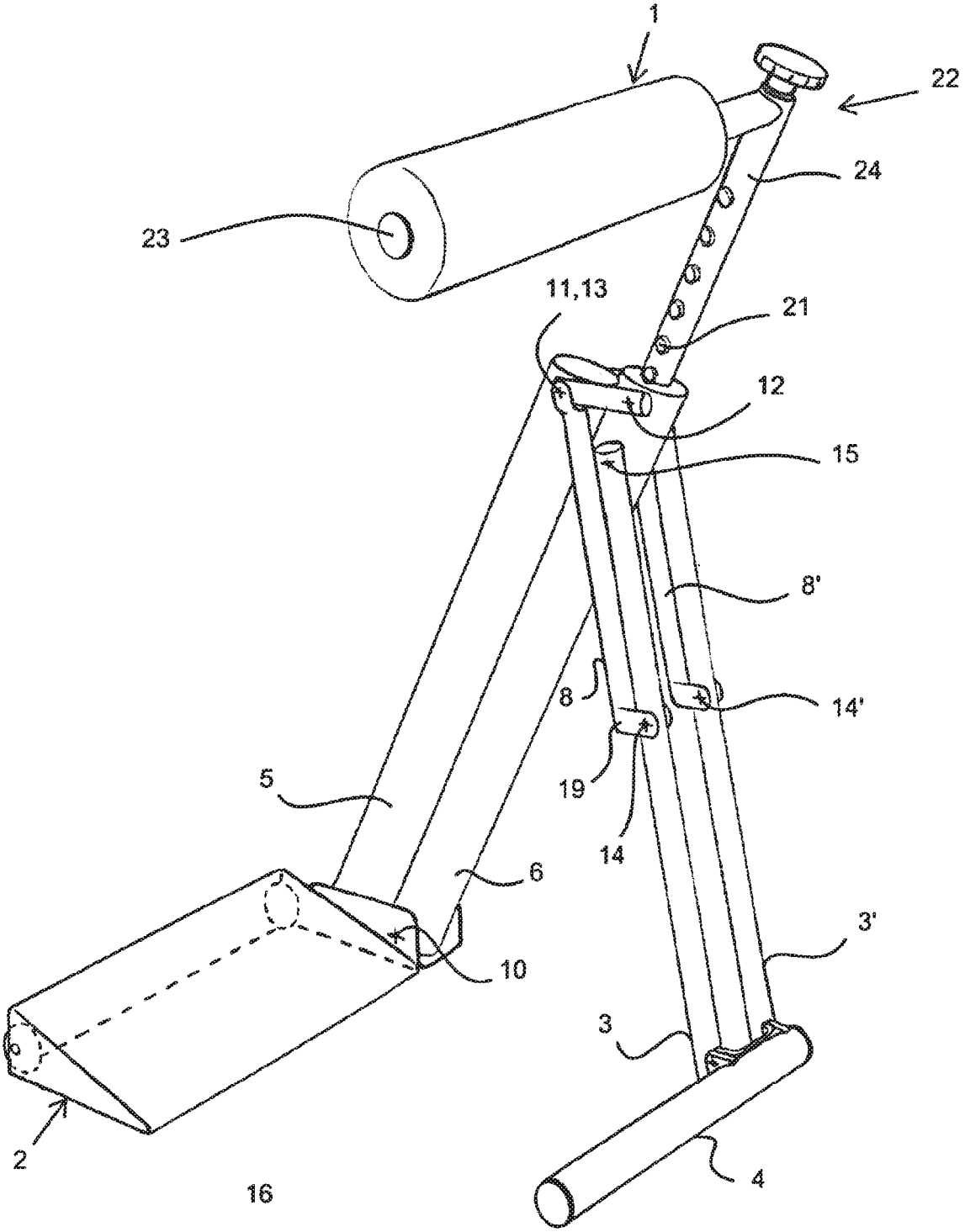
FIG. 3 illustrates a variant of the seat according to the invention.

According to an embodiment presented in FIG. 3, the seat comprises two modules, mobile in rotation. The two modules are arranged symmetrically on either side of the first module. In this way, the support of the seat is improved, in particular by limiting the risks of deformation in torsion of the modules. According to this embodiment, the seat therefore comprises two connecting rods 8, 8' two support legs 3,3' a foot 4. Advantageously, the seat comprises two rods 7, 7'. Each rod 7, 7' being arranged on either side of the first and second longitudinal elements 5-6.

According to a preferred possibility, the support leg 3 is itself connected, advantageously by the upper end thereof, to the first module, more specifically to the longitudinal element 6, by an articulation comprising an axis of rotation 15.

According to the invention, the second module is configured to be blocked in rotation in the direction of deployment by a surface contact between the support leg 3 and the connecting rod 8.

In the position of use, the surface contact 17 between the two longitudinal elements 5-6 of the first module and advantageously, the surface contact 18 between the support leg 3 and the connecting rod 8 preventing the seat to continue tilting in the direction of deployment 26. The rotation along the collapsing direction 27 is still possible. The transfer of the weight of the user on the base 1 on the first module and the second module favours surface contacts and therefore the blockage in the position of use of the seat.

The axes of rotation 13-14 of the articulations of the connecting rod 8 are parallel between them and perpendicular to the vertical plane, wherein the first and the second module are mobile in rotation.

Advantageously, the axes of rotation 9 to 15 of the first and of the second module are parallel to one another and perpendicular to the vertical plane wherein said modules are mobile in rotation.

The support leg 3 is intended to be in surface contact with the ground 16, in particular at the end of deployment of the seat. Advantageously, the support leg comprises a foot 4 extending transversally to the lower end of the support leg 3 so as to be in surface contact with the ground 16. According to the embodiment illustrated in FIG. 3, the seat comprises two support legs 3 and 3' fixed at the lower ends thereof to a common foot 4. Preferably, the foot 4 is provided with a non-slip coating intended to favour the contact with the ground 16 and therefore the maintaining in the position of use, i.e. deployed from the seat. In the position of use, the weight of the user exerted on the base 1 is transmitted to the first module and to the second module. The weight transmitted to the second module is taken by the support leg 3 and the foot 4. Advantageously, in the position of use, the foot 4 is arranged just under the base 1 and preferably behind the base 1, i.e. beyond the user when it is in the fold-up position.

According to an embodiment, the seat comprises a spring element making it possible advantageously for an automatic return of the position of use to the storage position of the seat, or to assist the user by alleviating the force linked to this movement. The return force of the spring is configured to be less than the force exerted by the weight of the user on the base 1. The return force is advantageously greater than the weight of the seat in the deployed position. Thus, in the absence of a force exerted on the base 1, the return force of the spring drives the seat to be collapsed in the storage position. Preferably, the spring element is arranged between the first module and the fixed support 2, alternatively, the spring element can be arranged between the first module and the furniture unit of the workstation, for example, when the seat is integral with a furniture unit.

Advantageously, the seat comprises a device for adjusting the height of the base 1. A possibility is illustrated in the figures. The device comprises tabs 21 mounted transversally on the vertical mount 24 of the bracket 22. Preferably, the tabs 21 are arranged in pairs symmetrically along the vertical mount 24.

According to a possibility, the tabs 21 can include numbers or be coloured so as to facilitate the adjustment of the height. The vertical mount 24 is configured to slide in the second longitudinal element 6. The second longitudinal element 6 comprises an internal slide intended to receive the vertical mount 24 and the tabs 21. The vertical mount 24 is mobile in rotation along the longitudinal axis thereof. The tabs 21 and the slide are complementary so as to make it possible for the sliding of the vertical mount 24 when the tabs 21 are aligned with the end openings of the slides and conversely, preventing the sliding of the vertical mount 24 when the tabs 21 are not aligned with the end openings of the slides. According to a possibility, the second longitudinal element 6 comprises at the upper end thereof, a cap blocking the slide and wherein the vertical mount 24 slides. The cap comprises complementarily-shaped slots of the tabs 21 so as to make it possible for the sliding of the vertical mount 24 when the tabs 21 are aligned with the slots and conversely, preventing the sliding of the vertical mount 24 when the tabs 21 are not aligned with the slots.

Preferably, the vertical mount 24 is capable of sliding in the second longitudinal element 6 when the seat is in the collapsed position. Advantageously, the vertical mount 24 is blocked in the second longitudinal element 6 when the seat is in the deployed position and that the base 1 is configured to receive the buttocks of the user.

Advantageously, the rotation of the vertical mount 24 along the longitudinal axis thereof is controlled by two stops 20 arranged on the cap and coming into contact with the tabs 21 to prevent a rotation of the vertical mount 24 over more than 180°. The base 1 can be used such as in the position illustrated in FIG. 2, i.e. that the base 1 is situated between the first module and the second module, i.e. on the same side as a fixed point such that the base 2 relative to the first module, in the so-called internal position. Advantageously, the base can be used in a so-called external position, i.e. that it is in a symmetrical position on the longitudinal element 6, relative to FIG. 2; the base 1 making it possible still for the pressure of the user, positioned on the other side of the first module. Due to this, the base 1 is configured to make it possible for a pressure of the user in the two positions, internal and external.

In the position of use, the base 1 is arranged substantially perpendicularly to the vertical plane wherein the first and the second module are mobile.

In the storage position, the base 1 can remain in the same plane perpendicularly to the vertical plane, wherein the first and the second module are mobile or be folded parallel to said vertical plane such as illustrated in FIG. 1. The latter position is advantageous when the seat is fixed on a furniture unit thus the base 1 is applied on a side wall of the furniture unit.

In the figures, the longitudinal elements 5-6, the rod 7, the support leg 3, the connecting rod 4, as well as the bracket are tubes of circular cross-section without being limiting. Some can be of different cross-sections such as in particular, square.

According to the invention, the first module extends into the vertical plane, wherein it is mobile in rotation. Likewise, the second module is mainly contained in a vertical plane, identical or parallel to that of the first module and wherein it is mobile in rotation, except for the foot 4 which is itself parallel to the ground. In this way, the seat has optimal ergonomics, making it possible for the user to pass very easily and rapidly from the fold-up position supported on the base 1, to an upright position to be moved, without risking being impeded by the elements of the seat at the level of the legs.

The invention relates to a method for using the seat.

The method comprises the following steps, making it possible for the passage from the storage position to the position of use by a deployment step and conversely, from the position of use to the storage position, by a collapsing step.

The step of deploying the step comprises the tilting of the first module in a vertical plane along a direction of rotation called direction of deployment 26 about at least one axis of rotation. This tilting is illustrated by the arrow referenced A1 in FIG. 2. The first module is extended from a vertical position wherein the longitudinal elements 5-6 are close to a vertical position. Simultaneously to the tilting of the first module, the method comprises the tilting of the second module in a vertical plane, identical or parallel to the vertical plane wherein the first module tilts. This tilting is illustrated by the arrow referenced A2 in FIG. 2. The support leg 3 is deviated from the first module according to a rotation about at least one axis of rotation 13-15.

The simultaneous tilting of the first or second module are stopped when the two modules can no longer rotate about the axes of rotation thereof, preferably according to the surface contact 17 between the two longitudinal elements 5-6 of the first module and the surface contact 18 between the support leg 3 and the connecting rod 8.

Advantageously, the deployment step then comprises a step of positioning the base, preferably comprising a step of adapting the height of the base 1. The base 1 is moved by sliding the vertical mount 24 of the bracket 22, in the longitudinal element 6. This sliding is illustrated by the arrow referenced B in FIG. 2. The blocking in position, of the base 1, is done advantageously by rotation of the base 1 about the longitudinal axis thereof. This movement is illustrated by the arrow referenced C in FIG. 2.

Advantageously, the base 1 comprises a handle 25 facilitating the deployment of the seat.

Conversely, the method preferably comprises a step of collapsing the seat, from a position of use to a storage position.

According to an embodiment, wherein the seat comprises a spring element making it possible for automatic collapsing, the fact that the user stops exerting a pressure on the base 1 is sufficient to trigger the steps of collapsing the seat.

The step of collapsing the seat comprises the tilting of the first module in a vertical plane along the direction of rotation called collapsing direction 27, about at least one axis of rotation. This tilting is the opposite of that referenced A1. The first module draws near a vertical position wherein the longitudinal elements 5-6 are close to a vertical position. Simultaneously to the tilting of the first module, the method comprises the tilting of the second module in a vertical plane, identical or parallel to the vertical plane, wherein the first module tilts. This tilting is the opposite of that illustrated by the arrow references A2 in FIG. 2. The support leg 3 draws near the first module according to the rotation about at least one axis of rotation 13-15.

Advantageously, the collapsing step then comprises a step of positioning the base preferably comprising a step of reducing the height of the base 1. The unblocking of the base 1 is done advantageously by rotation of the base 1 about the longitudinal axis thereof. This movement is the opposite of that illustrated by the arrow referenced C in FIG. 2. Then, the base 1 is moved by sliding the vertical mount 24 of the bracket 22 in the second longitudinal element 6. This sliding is opposite that illustrated by the arrow referenced B in FIG. 2.

REFERENCES

1. Base
2. Fixed support
3. Support leg
4. Feet
5. First longitudinal element
6. Second longitudinal element
7. Rod
8. Connecting rod
9. First axis of rotation
10. Second axis of rotation
11. Third axis of rotation
12. Fourth axis of rotation
13. Fifth axis of rotation
14. Sixth axis of rotation
15. Seventh axis of rotation
16. Ground
17. Surface contact

18. Surface contact
19. Tab
20. Stop
21. Tab
22. Bracket
23. Cross member
24. Vertical mount
25. Handle
26. Direction of deployment
27. Collapsing direction
28. Longitudinal axis of the first longitudinal element in the storage position
29. Longitudinal axis of the second longitudinal element in the storage position
30. Longitudinal axis of the first longitudinal axis in the position of use
I. seat width

The invention claimed is:

1. A collapsible seat comprising a base intended to receive the buttocks of a user, the seat being configured to alternatively take a position of use wherein the seat is deployed such that the base can support the buttocks of the user and a storage position wherein the seat is collapsed, the base not being able to receive the buttocks of the user, wherein the seat comprises:

a first module, rotatable in a vertical plane and comprising longitudinal elements, the first module being articulated about at least one axis of rotation mounted on a fixed support, configured such that in the position of use at least two longitudinal elements are in surface contact blocking the rotation of the first module along at least one direction of rotation, a second module, rotatable in the same vertical plane as the first module and comprising a support leg configured to be in surface contact with the ground in the position of use and a connecting rod fixed at a first end to the first module and at a second end to the support leg, the second module being configured such that in the position of use, the connecting rod and the support leg are in surface contact blocking the rotation of the second module along at least one direction of rotation.

2. The seat according to claim 1, wherein the first module comprises a first longitudinal element and a second longitudinal element respectively fixed at lower ends thereof to the fixed support by a first axis of rotation and a second axis of rotation, the first axis of rotation and the second axis of rotation being parallel.

3. The seat according to claim 2, wherein the connecting rod is fixed by an axis of rotation at an end to the first longitudinal element and to the end thereof opposite the support leg by an axis of rotation.

4. The seat according to claim 2, wherein the first longitudinal element and the second longitudinal element are connected to one another at upper ends thereof by a rod.

5. The seat according to claim 1, wherein the support leg comprises a foot extending transversally and making it possible for support of the support leg on the ground.

6. The seat according to claim 1, wherein the connecting rod is arranged in an upper portion of the support leg remotely.

7. The seat according to claim 1, wherein the support leg is fixed by an axis of rotation to a second longitudinal element of the at least two longitudinal elements of the first module.

8. The seat according to claim 1, wherein the base is mounted on a bracket comprising a cross member and a vertical mount slidably mounted in the second longitudinal element of the first module.

9. The seat according to claim 8, wherein the vertical mount is configured to be rotatable relative to the second longitudinal element of the first module.

10. The seat according to claim 1 comprising a device for adjusting the height of the base.

11. The seat according to claim 1, wherein the base comprises a gripping element making it possible for gripping of the base by the user and the passage to the position of use of the seat.

12. The seat according to claim 1 comprising a spring element making it possible for an automatic return to the storage position of the seat from the absence of force on the base.

13. A method for using a seat according to claim 3 comprising the following steps:

deployment of the seat from a storage position to a position of use comprising a tilting of the first module in a vertical plane along a direction of rotation about at least one axis of rotation simultaneously to a tilting of the support leg in the same vertical plane about an axis of rotation in a direction of rotation to the support leg is in surface contact with the ground and that at least two longitudinal elements of the first module are in contact with one another so as to block the rotation of the first module along at least one direction of rotation and that the support leg and the connecting rod thereof are in contact with one another so as to block the rotation of the second module along at least one direction of rotation; and collapsing of the seat from the position of use to the storage position comprising the tilting of the support leg (3) in the vertical plane about the axis of rotation (13) in the direction of rotation contrary to that of the deployment step simultaneously to the tilting of the first module in the same vertical plane along a direction of rotation contrary to that of the deployment step about the first axis of rotation.

14. The method of using a seat according to claim 13 comprising, in the deployment of the seat, gripping of the base driving the tilting of the first module and of the support leg.

15. The method for using a seat according to claim 13 comprising adjustment of the height of the base by sliding and rotation of the base relative to the second longitudinal element of the first module.

* * * * *